US006932492B2

(12) United States Patent
Tumlinson et al.

(10) Patent No.: US 6,932,492 B2
(45) Date of Patent: Aug. 23, 2005

(54) COMBINATION LAMP ASSEMBLY

(75) Inventors: Alexandre Rex Tumlinson, Tucson, AZ (US); Aaron Cole Rubin, Tucson, AZ (US)

(73) Assignee: AAA Doodads, L.L.C., Tucson, AZ (US)

( * ) Notice: Subject to any disclaimer, the term of this patent is extended or adjusted under 35 U.S.C. 154(b) by 74 days.

(21) Appl. No.: 10/461,525

(22) Filed: Jun. 13, 2003

(65) Prior Publication Data

US 2004/0252499 A1 Dec. 16, 2004

(51) Int. Cl.[7] ..... F21S 8/08
(52) U.S. Cl. ..... 362/228; 362/229; 362/410; 362/414
(58) Field of Search ..... 362/228, 229, 362/235, 249, 260, 410, 431, 414

(56) References Cited

U.S. PATENT DOCUMENTS 4,091,441 A * 5/1978 Ott ..... 362/1
5,866,994 A * 2/1999 Nakano ..... 315/362
6,079,838 A * 6/2000 Parker et al. ..... 362/31
6,174,078 B1 * 1/2001 Ohm et al. ..... 362/477
6,592,240 B2 * 7/2003 Camarota et al. ..... 362/399

* cited by examiner

*Primary Examiner*—Thomas M. Sember
(74) *Attorney, Agent, or Firm*—Harry M. Weiss; Weiss, Moy & Harris, P.C.

(57) ABSTRACT

A combination lamp assembly which includes at least one gas-filled luminescent bulb such as a black light lamp and a fluorescent light and at least one other type lamp or light such as an incandescent light such as a halogen light and lamp bulb, and/or a fluorescent light bulb is disclosed wherein the different light bulb or light sources are preferably assembled within the same combination lamp assembly allowing a user to manually select between the light sources as desired.

5 Claims, 2 Drawing Sheets

COMBINATION LAMP ASSEMBLY

FIELD OF THE INVENTION

This invention relates generally to lamps, and more specifically, to a combination lamp assembly which includes a gas-filled luminescent bulb such as a black light lamp and an incandescent light such as a halogen lamp or light bulb thereby providing characteristic of versatility, durability, convenience, and ease of use.

BACKGROUND OF THE INVENTION

Today, black lights have become a common accessory. Black light lamps emit ultraviolet light which is in the UV light spectrum. A black light emits ultraviolet light that is invisible to the human eye. However, when the ultraviolet light comes into contact with certain materials, the light causes the material to fluoresce. This is especially useful in, for example, finding scorpions who fluoresce when a black light is used.

Black lights are not traditionally used on a daily basis because the ultraviolet light is not optimal for illuminating a room. When desired, however, individuals often replace the standard incandescent and fluorescent light bulbs of common household lamps and light fixtures with black light bulbs.

Switching the standard light bulbs with the black light bulbs may prove to be inconvenient because the individual would need to keep track of each bulb whenever it was not in use. While unused, these light bulbs may be lost or damaged in storage. The task of switching the light bulbs may also be time-consuming and the alternative choice of purchasing a separate lamp or light fixture for a black light bulb could be expensive.

Therefore, a need existed for a combination lamp assembly that would use, in one assembly, different types of lamps or bulbs. More specifically, a need existed for a combination lamp assembly which would include a gas-filled luminescent bulb such as a black light lamp or a fluorescent light and an incandescent light such as a halogen lamp or light bulb wherein the black light lamp or bulb and at least one of the other above mentioned lights or bulbs are part of the same lamp assembly thereby allowing a user to manually select between the light sources as desired. The term gas-filled luminescent bulb as used in this application including the claims is intended to cover both a black light lamp or bulb and a fluorescent light since both are gas-filled luminescent bulbs. The term black light lamp as used in this application including the claims is intended to cover any lamp or bulb that emits UV light. The term light bulb as used in this application including the claims is intended to cover any light source that emits visible light.

SUMMARY OF THE INVENTION

An object of the present invention is to provide a combination lamp assembly which would include at least one gas-filled luminescent bulb such as a black light lamp or fluorescent light and at least one of an incandescent light such as a halogen lamp or light bulb, and/or another gas-filled luminescent bulb such as a fluorescent light wherein the gas-filled luminescent bulb such as a black light lamp or bulb or the fluorescent light and the at least one other light or bulb or lamp noted above are preferably assembled within the same lamp assembly thereby allowing a user to manually select between the light sources as desired.

It is another more specific object of this invention to provide a light stand or assembly which contains both a halogen and black light lamp, that are separately controlled to selectively provide one or the other type of light.

It is still another more specific object of this invention to provide a light assembly which includes both at least one fluorescent light and at least one light bulb in one assembly to selectively provide one or the other type light.

BRIEF DESCRIPTION OF THE PREFERRED EMBODIMENTS

In accordance with one embodiment of the present invention, a combination lamp assembly is disclosed which comprises, in combination: a lamp apparatus connectable to an AC source and having at least one black light lamp and at least one other light unit that emits light in the visible spectrum. The lamp apparatus comprises an upper lamp cover opening upwardly and having a halogen light source located within the cover. The lamp apparatus also has a lower base portion for supporting the lamp assembly. A substantially vertical stem connects the housing to the lower base portion and a black light source is located within the vertical stem.

In accordance with another embodiment of the present invention, a combination halogen and black light lamp assembly is provided which comprises, in combination: an upper lamp cover opening upwardly, a halogen light source located within the upper lamp cover, and a black light source coupled to the upper lamp cover. The lamp apparatus of this embodiment also has a lower base portion for supporting the lamp assembly and a substantially vertical stem connecting the upper lamp cover to the lower base portion.

In accordance with still another embodiment of this invention, a combination fluorescent light and light bulb lamp apparatus comprises a fluorescent light tube assembly, and at least one light bulb coupled to the fluorescent light tube assembly to permit a user to select at least one of a fluorescent light and incandescent light wherein at least one of the fluorescent light tube assembly and the at least one light bulb being movable.

The foregoing and other objects, features, and advantages of the invention will be apparent from the following, more particular description of the preferred embodiments of the invention, as illustrated in the accompanying drawings.

DESCRIPTION OF THE PREFERRED EMBODIMENTS

Figure 1:
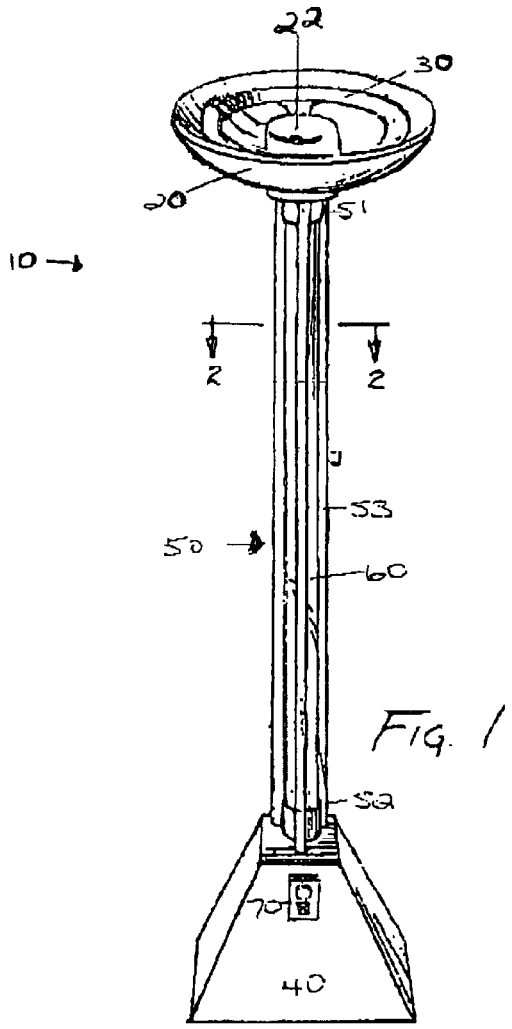
FIG. 1 is a perspective view of a first combination lamp embodiment of the present invention, shown with a multiple (i.e. 3) rod stem.
Figure 2:
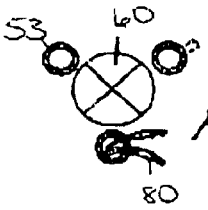
FIG. 2 is a cross-sectional view of the stem and black light source of the combination lamp of FIG. 1, taken along line 2—2 of FIG. 1.
Figure 3:
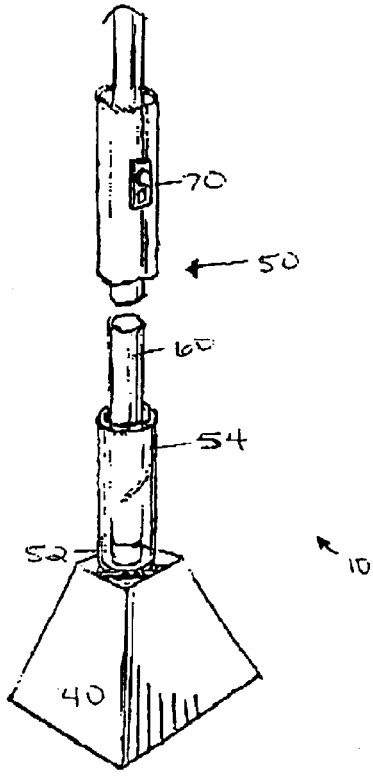
FIG. 3 is a perspective view of the base portion and stem of a second combination lamp embodiment of the present invention, shown with a transparent casing stem.

FIGS. 1–3 refer to, for example, a combination lamp assembly 10 comprising an upper lamp cover 20 opening upwardly and, for example, a halogen light source 22 located within a transparent cover and a fluorescent light bulb 30 configured in a substantially circular configuration or, if desired, any other shape or configuration located within the cover 20. The cover 20 can have a concave or conical shaped configuration. Also, if desired, instead of a halogen light, an incandescent light bulb 22 or an LED (light Emitting Diode) or LASER type light may be located within the transparent cover or, if desired, any of these visible light sources can be used without a cover. In the embodiment illustrated in FIGS. 1–3, a vertical black light source or tube 60 is also shown. Thus, any desired combination light arrangement may be provided or the combination light arrangement may be limited to any one of the above noted light sources. The lamp assembly 10 preferably has a substantially solid base portion 40 for supporting the upper portion of the lamp assembly 10 and a substantially vertical stem generally designated by reference number 50 connecting the cover 20 to the base portion 40.

Preferably the black light source 60 is located within the stem 50. The stem 50 has a first end 51 and a second end 52 preferably demountably connected to the cover 20 and the base portion 40, respectively, so as to allow, for example, for easy removal of the black light source 60 when it requires replacement. In the first embodiment of FIG. 1, the stem 50 is comprised of multiple support rods 53 (preferably at least three support rods 53, spaced equidistantly for optimal weight distribution and support are used). These three support rods 53 can be spaced and sized, if desired, to permit the black light sources 60 to be-removed and replaced therethrough. These support rods 53 may be substantially transparent or substantially opaque. These support rods 53 may, if desired, have a tapered configuration (upwardly or downwardly tapered) to permit other ways to remove the black light tube 60 through an enlarged opening in the tapered rods (upwardly or downwardly). These support rods 53 may also be solid or hollow to allow for the passage of electrical wires 80 (shown for example in one support rod 53 in FIG. 2). Here, a control switch 70 is shown coupled to the base portion 40. If desired, the control switch 70 may be located on a portion of the stem 50 (as shown in FIG. 3) or elsewhere. The control switch 70 allows a user to manually select between the light sources as desired. Also, the control switch 70 can be used to act as a light dimmer or light timer and thereby function as a light control device for any of the noted light sources.

FIG. 2 shows three hollow support rods 53, with electrical wires 80 passing, for example, through one of the support rods 53. The black light source 60 is also shown in FIG. 2 with the support rods 53 spaced equidistantly around it.

In the embodiment as shown in FIG. 3, the stem 50 is preferably comprised of a transparent casing 54 allowing for both protection and visibility of the black light source 60 while also providing a mechanical structure that can support the cover 20 (see FIG. 1) above the base portion 40. Here, the control switch 70 is preferably shown coupled to the stem 50 rather than to the base 40 as shown in FIG. 1.

Figure 4:
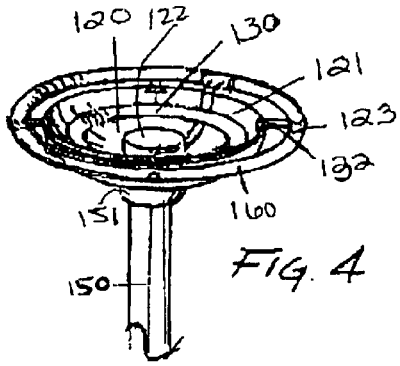
FIG. 4 is a perspective view of an upper portion of a third combination lamp embodiment of the present invention.

FIG. 4 is directed to another embodiment of this invention which comprises an upper lamp cover 120 opening upwardly as part of at least a combination halogen and black light lamp assembly 110. A halogen light source 122 is located within the cover 120. The cover 120 has an outer perimeter portion 121 and preferably multiple (i.e. at least three) gripping members 132 extending substantially horizontally and outwardly from the outer perimeter portion 121. These gripping members 122 are preferably spaced equidistantly along the outer perimeter portion 121 so as to provide optimal support to and for a substantially circular black light source 160 concentrically spaced from a substantially circular fluorescent light source 130. Each gripping member 132 has an attachment end 123 that engages the black light source 160 to hold the black light source 160 in place.

Also shown is a stem 150 and its first end 151 that is preferably demountably connected to the cover 120. This allows for ease of assembly and disassembly.

Figure 5:
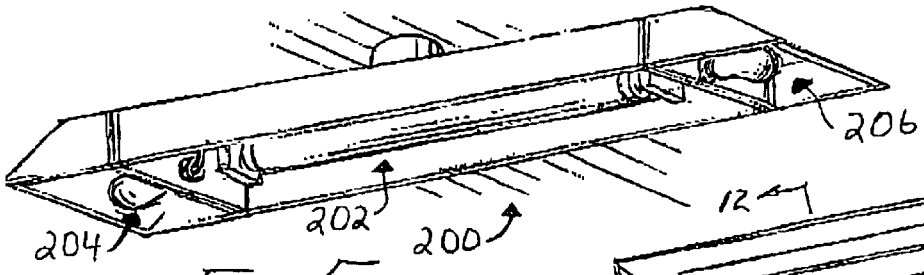
FIG. 5 is a perspective view of an embodiment of this invention showing a combination of fluorescent and incandescent light bulb units in one assembly.

Referring to FIG. 5, reference number 200 generally refers to the combination assembly embodiment depicted in FIG. 5 of a fluorescent light unit 202 preferably centrally located between two separate light bulb units 204 and 206. If desired, only one light bulb unit can be used with the fluorescent light unit 202 or, alternatively, more than one fluorescent light unit can be used in the same combination light arrangement with one or more light bulb units. As shown in FIG. 5, the combination assembly embodiment 200 is shown suspended from a ceiling.

Figure 6:
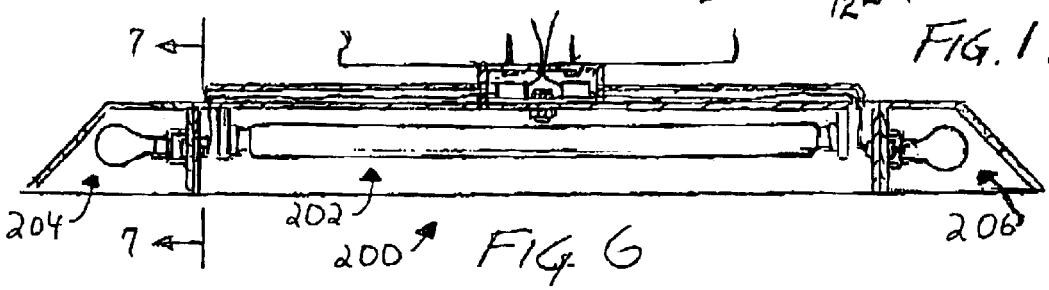
FIG. 6 is a side elevational view of the combination assembly of FIG. 5 with parts broken away to show the arrangement of the fluorescent light and the light bulbs.

Referring to FIG. 6, the details of the wiring of the different units of the combination assembly embodiment 200 is shown as well as the mechanical connection of the different units within the combination assembly embodiment 200.

Figure 7:
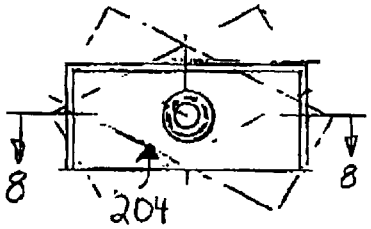
FIG. 7 is a sectional view taken on the line 7—7 of FIG. 6 showing the rear portion of the connection of one of the light bulbs within the combination assembly.

FIG. 7 is a sectional view taken on line 7—7 of FIG. 6 and shows different rotational positions that can be created for the light bulb unit 204. The other light bulb unit 206 can also be rotated to different rotational positions as shown for the light bulb unit 206 in FIG. 7.

Figure 8:
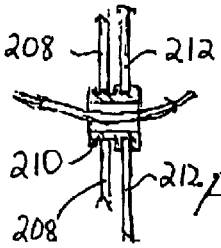
FIG. 8 is a sectional view taken on the 8—8 of FIG. 7.

FIG. 8 is a sectional view taken on line 8—8 of FIG. 7 which depicts the mechanical connection for the light bulb unit 204 that permits the rotational positions shown in FIG. 7. Vertical member 208 rotates around Center hub member 210 to permit the light bulb unit 204 to take any of the rotational positions shown in FIG. 7. The center hub member 210 is connected to vertical member 212 to provide mechanical connection to the inner frame portion of assembly 200.

Figure 9:
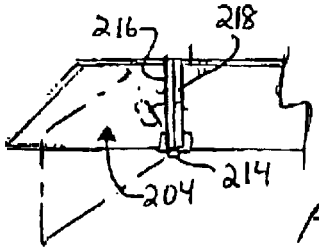
FIG. 9 is a partial side elevational view with parts broken away to show a pivotable hinge connection between one of the light bulb units and a side of the fluorescent light portion of the combination assembly.

FIG. 9 depicts another method of moving the light bulb unit 204 (other than the rotational method shown in FIGS. 7 and 8). In the embodiment of FIG. 9, a hinge 214 is provided at preferably the bottom portion of members 216 and 218 in order to permit the light bulb unit 206 to pivot, for example, as shown in FIG. 9 (phantom lines) thereby providing another way of moving the light bulb unit 204.

Thus member 216 pivots downwardly while member 218 remains in a vertical position.

Figure 10:
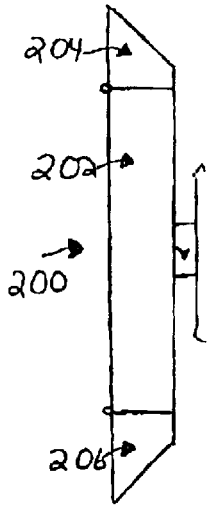
FIG. 10 is a side elevational view of the combination assembly of FIG. 5 wherein the combination assembly is mounted on a wall rather than on the ceiling as shown in FIG. 5.

Referring to FIG. 10, the combination assembly 200 and its associated units (fluorescent light unit 202, and lamp bulb units 204 and 206) are shown connected to a wall rather than the ceiling as depicted in FIG. 5.

Figure 11:
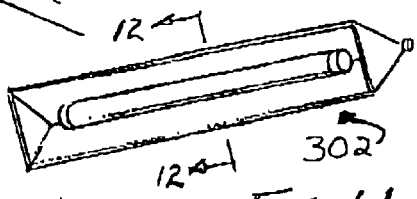
FIG. 11 is a perspective view of another embodiment illustrating a rotatable fluorescent light unit that can be rotated in a number of different positions to shine fluorescent light in a number of different directions.

Referring to FIG. 11, this embodiment depicts a method of rotating a fluorescent light unit 302 for providing light in different directions. The fluorescent light unit 302 can be either ceiling or wall mounted.

Figure 12:
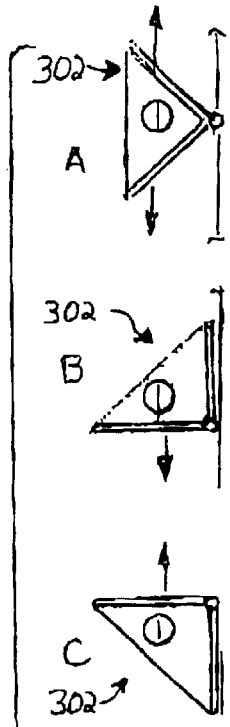
FIGS. 12A, B and C illustrate, for example, three different positions for rotating the fluorescent light unit of FIG. 11.

FIGS. 12A, B and C illustrates for example, different fluorescent light positions using the fluorescent light unit 302 shown in FIG. 11 which can be pivoted to any, for example, position shown in FIGS. 12A, B and C.

While the invention has been particularly shown and described with reference to preferred embodiments thereof, it will be understood by those skilled in the art that the foregoing and other changes in form and detail may be made therein without departing from the spirit and scope of the invention.

What is claimed is:

1. A combination lamp assembly comprising, in combination:

a lamp apparatus connectable to an AC source and having at least one black light lamp;

at least one other light unit that emits light in the visible spectrum;

said lamp apparatus comprises:

an upper lamp cover opening upwardly;

a halogen light source located within the cover;

a lower base portion for supporting the lamp assembly;

a substantially vertical stem connecting the cover to the lower base portion;

a black light lamp located within the vertical stem; and the stem has a second end demountably connected to the lower base portion for allowing the user to remove the stem in order to replace the black light lamp as needed.

2. A combination lamp assembly comprising, in combination:

a lamp apparatus connectable to an AC source and having at least one black light lamp;

at least one other light unit that emits light in the visible spectrum;

said lamp apparatus comprises:

an upper lamp cover opening upwardly;

a halogen light source located within the cover;

a lower base portion for supporting the lamp assembly;

a substantially vertical stem connecting the cover to the lower base portion;

a black light lamp located within the vertical stem; and the stem comprises a plurality of support rods spaced equidistantly for optimal weight distribution and support.

3. The lamp assembly of claim 2 wherein the support rods are one of substantially transparent and substantially opaque.

4. The lamp assembly of claim 2 wherein at least one of the support rods is hollow for allowing electrical wires to be passed therethrough.

5. A combination lamp assembly comprising, in combination:

a lamp apparatus connectable to an AC source and having at least one black light lamp;

at least one other light unit that emits light in the visible spectrum;

said lamp apparatus comprises:

an upper lamp cover having a substantially concave configuration and opening outwardly;

at least one light source located within the cover comprising at least one of the following: an incandescent light; a fluorescent light, a halogen light, an LED light and a LASER light to provide at least one source of light extending upwardly from within said concave configuration of said upper lamp cover;

a lower base portion for supporting the lamp assembly;

a substantially vertical stem connecting the cover to the lower base portion; and a black light lamp located within the vertical stem.

* * * * *